US005540566A

United States Patent [19]

Ishizaki et al.

[11] Patent Number: 5,540,566

[45] Date of Patent: Jul. 30, 1996

[54] PUMP INCLUDING A CONTROL VALVE

[75] Inventors: Kazuyoshi Ishizaki; Masateru Yamamuro; Atsushi Ishizuka; Shouji Ohya; Miyoko Hamao, all of Atsugi, Japan

[73] Assignee: Unista Jecs Corporation, Japan

[21] Appl. No.: 103,989

[22] Filed: Aug. 10, 1993

[30] Foreign Application Priority Data

Aug. 11, 1992 [JP] Japan ..... 4-061751 U

[51] Int. Cl.[6] ..... F04B 49/00

[52] U.S. Cl. ..... 417/297; 277/901; 277/180; 417/300

[58] Field of Search ..... 417/297, 300; 137/503; 251/148, 152; 277/180, 227, 901

[56] References Cited

U.S. PATENT DOCUMENTS

| | | | |
|---|---|---|---|
| 634,848 | 10/1899 | Courson . | |
| 1,352,470 | 9/1920 | Palmer | 277/227 |
| 2,020,844 | 11/1935 | Magos et al. . | |
| 2,455,982 | 12/1948 | Dowty | 277/180 |
| 2,628,570 | 2/1953 | De Luca . | |
| 2,698,579 | 1/1955 | Hammond | 417/300 |
| 2,732,169 | 1/1956 | Matteo . | |
| 3,009,722 | 11/1961 | Augustin | 277/180 |
| 3,019,281 | 1/1962 | Hartwell . | |
| 3,140,342 | 7/1964 | Ehrreich et al. . | |
| 3,215,442 | 11/1965 | Papenguth | 277/180 |
| 3,989,285 | 11/1976 | Yancy | 285/336 |
| 4,026,565 | 5/1977 | Jelinek | 277/180 |
| 4,047,846 | 9/1977 | Komamura et al. | 417/300 |
| 4,099,893 | 7/1978 | Coffman | 417/300 |
| 4,188,041 | 10/1978 | Futamura . | |
| 4,251,193 | 2/1981 | Minnis et al. | 417/300 |
| 4,311,161 | 1/1982 | Narumi et al. | 417/300 |
| 4,456,221 | 6/1984 | Bryant . | |
| 4,570,667 | 2/1986 | Masica et al. . | |
| 4,577,872 | 3/1986 | Bake et al. . | |

FOREIGN PATENT DOCUMENTS

| | | | |
|---|---|---|---|
| 31262 | 3/1977 | Japan . | |
| 18380 | 1/1989 | Japan . | |
| 883464 | 1/1961 | United Kingdom | 277/180 |
| 85/03334 | 8/1985 | WIPO | 277/227 |

*Primary Examiner*—Richard A. Bertsch
*Assistant Examiner*—Ted Kim
*Attorney, Agent, or Firm*—Bachman & LaPointe, P.C.

[57] ABSTRACT

A pump comprising a pump body having a control valve for controlling working fluid flow from the pump body to an actuator through a joint. The joint is connected mechanically to the pump body through a washer made of a material different from that of the pump body. The washer has a side surface held in contact with the pump body at a galvanic junction. The pump also includes an annular seal member provided to keep the junction from exposure to the environment.

5 Claims, 6 Drawing Sheets

PUMP INCLUDING A CONTROL VALVE

BACKGROUND OF THE INVENTION

This invention relates to a pump of the type including a pump body having a control valve for controlling working fluid flow from the pump body to an actuator through a joint.

In such a pump, the pump body is mechanically connected to the joint. It is the current practice to reduce the total weight of the pump by making the pump body of an aluminum alloy. In this case, the aluminum alloy of the pump body and the iron of the joint form a galvanic junction which is susceptible to corrosion. If the pump body is mechanically connected to the pump body through a washer made of iron, the aluminum alloy of the pump body and the iron of the washer will form a galvanic junction which is susceptible to corrosion.

SUMMARY OF THE INVENTION

It is a main object of the invention to provide an improved pump which can eliminate the tendency of the pump body toward corrosion particularly at its junction to the washer or the joint.

There is provided, in accordance with the invention, a pump comprising a pump body having a control valve for controlling working fluid flow from the pump body to an actuator through a joint. The joint is connected mechanically to the pump body through a washer made of a material different from that of the pump body. The washer has a side surface held in contact with the pump body at a junction. The pump also includes an annular seal member provided to keep the junction unexposed to the environment.

In another aspect of the invention, the pump comprises a pump body having a control valve for controlling working fluid flow from the pump body to an actuator through a joint. The joint is connected mechanically to the pump body through a washer made of a material different from that of the pump body. The pump also includes an annular member provided between the pump body and the washer. The annular member is made of an insulating material to prevent electrical conduction between the pump body and the washer.

In another aspect of the invention, the pump comprises a pump body having a control valve for controlling working fluid flow from the pump body to an actuator through a joint. The joint is connected mechanically to the pump body through a washer made of a material different from that of the pump body. The washer is placed in an annular recess formed in the inner peripheral surface of the pump body.

In another aspect of the invention, the pump comprises a pump body having a control valve for controlling working fluid flow from the pump body to an actuator through a joint. The joint is connected mechanically to the pump body through a washer made of a material different from that of the pump body. The washer is placed in an annular recess formed in the inner peripheral surface of the joint.

In another aspect of the invention, the pump comprises a pump body having a control valve for controlling working fluid flow from the pump body to an actuator through a joint made of a material different from that of the pump body. The joint is directly connected mechanically to the pump body at a junction. The pump also includes an annular seal member provided to keep the junction from exposure to the environment.

In still another aspect of the invention, the pump comprises a pump body having a control valve for controlling working fluid flow from the pump body to an actuator through a joint made of a material different from that of the pump body. The joint is directly connected mechanically to the pump body at a junction. The pump also includes an annular member provided between the pump body and the joint. The annular member is made of an insulating material to prevent electrical conduction through the junction.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
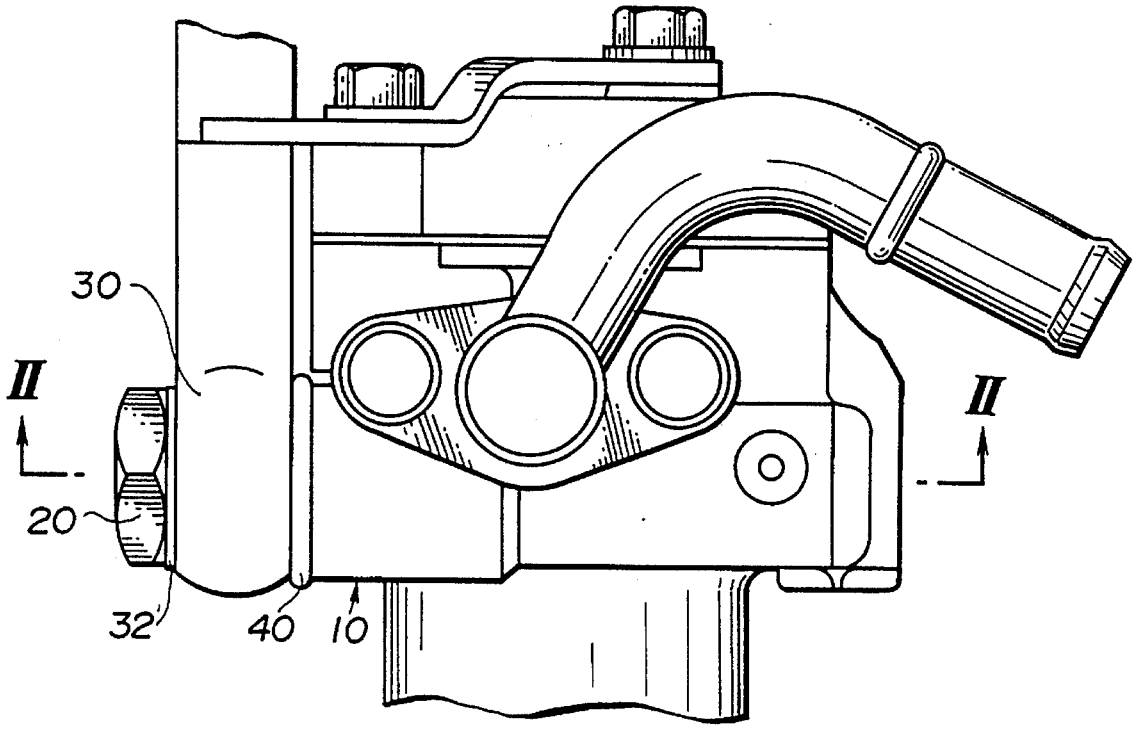
FIG. 1 is an elevational view showing one embodiment of a pump made in accordance with the invention.
Figure 2:
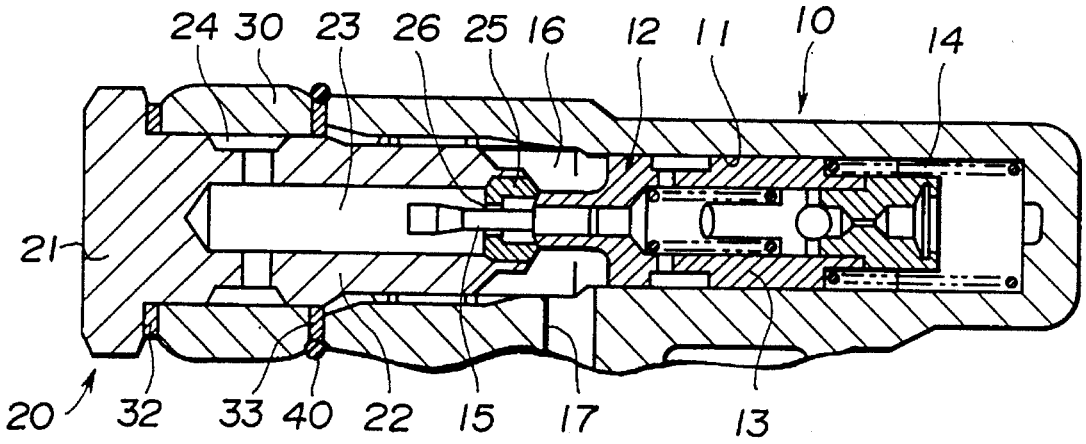
FIG. 2 is a sectional view taken along the lines II—II of FIG. 1.

With reference to the drawings, and in particular to FIGS. 1 and 2, there is shown a pump embodying the invention. In the illustrated case, the pump is used in an automotive vehicle to supply working fluid to its power steering unit. The pump comprises a pump body 10, a connector 20, and a joint 30, all generally axially aligned. The pump body 10, which is made of an aluminum alloy, is provided with a longitudinally extending bore 11 closed at its one end. The other end of the bore 11 is open. The connector 20 has a head portion 21 and a stem portion 22 on which the joint 30 is mounted at a position adjacent to the head portion 21. The stem portion 22 is inserted into the bore 11 so as to mount the joint 30 between the head portion 21 and the annular end wall of the pump body 10. The stem portion 22 has a longitudinally extending passage 23 connected to an annular passage 24 formed in its peripheral surface on which the joint 30 is mounted. The passage 23 opens out of the bottom of the connector 20 in an enlarged recess into which an insert 25 is tightly fitted. The insert 25 has a control orifice (center aperture) 26 therein. The bore 11 contains a flow control valve 12 having a valve body 13 provided for longitudinal sliding movement within the bore 11. A compression spring 14 is placed to urge the valve body 13 into abutment against the insert 25. The valve body 13 has a needle 15 extending through the control orifice 26. A pressure chamber 16 is defined in the bore 11 between the valve body 13 and the connector 20. The pressure chamber 16 is connected to a pressure source (not shown) through an inlet port 17 formed in the pump body 10.

Working fluid is introduced under pressure through the inlet port 17 in to the pressure chamber 16. According to a pressure differential produced across the control orifice 26, the needle 15 opens and closes the control orifice 26 to control the flow of the working fluid through the control orifice 26 from the pressure chamber 16 to the passage 23. The working fluid is then discharged into the annular passage 24 and hence through the joint 30 to an actuator (not shown) used in the power steering unit.

Figure 3:
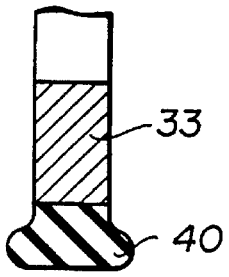
FIG. 3 is a fragmentary sectional view showing a modified form of the seal member of FIG. 2.

A washer 32 is positioned around the stem portion 22 of the connector 20 between the joint 30 and the head portion 21 of the connector. Another washer 33 is provided around the stem portion 22 of the connector 20 between the joint 30 and the annular end wall of the pump body 10. The washers 32 and 33 are made of a material, for example, copper alloy, different from that of the pump body 10. The different materials of the washer 33 and the pump body 10 form a galvanic junction which is susceptible to corrosion. An annular seal member 40 is provided on the washer 33 between the pump body 10 and the joint 30. The seal member 40, which may be made of rubber, synthetic resin, or the like, has a thickness greater than that of the washer 33 to cover the whole area of the outer peripheral surface of the washer 33 so as to keep the junction between the pump body 10 and the washer 33 unexposed to the environment and prevent water and/or brine from coming into contact with the junction between the pump body 10 and the washer 33. This is effective to prevent corrosion of the pump body 10. As shown in FIG. 3, the seal member 40 may be integrally joined to the washer 33, for example, by an adhesive coated on the outer peripheral surface of the washer 33.

The seal member 40 may be made of a material, for example, zinc alloy, baser than those of the pump body 10, the joint 30 and the washer 33. In this case, electrochemical corrosion may occur at the junction of the seal member 40 to one of the pump body 10, the joint 30 and the washer 33 in the presence of water and/or brine. However, the zinc alloy of the seal member 40 will first be subject to corrosion. This is effective to avoid corrosion of the pump body 10.

Figure 4:
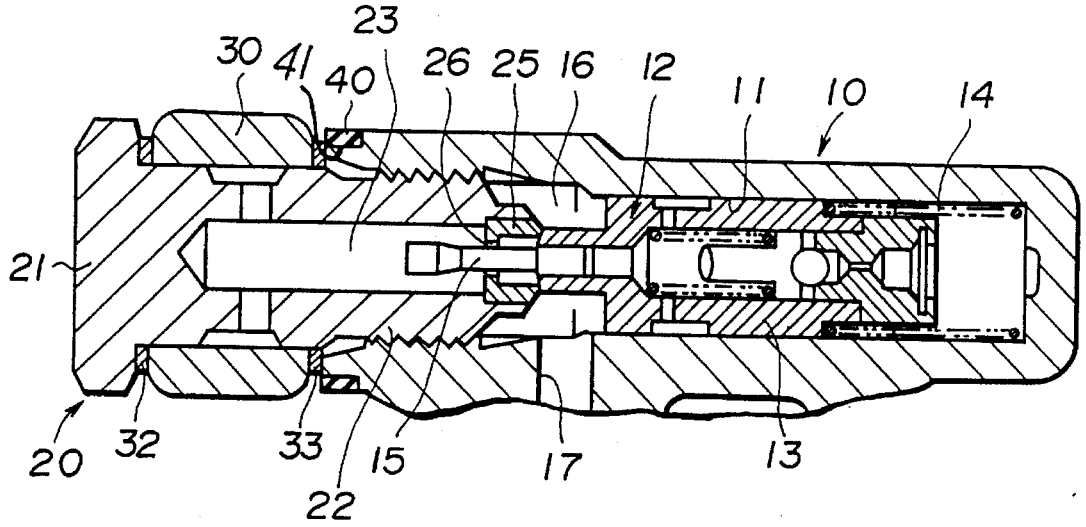
FIG. 4 is a sectional view showing a second embodiment of the pump of the invention.

Referring to FIG. 4, there is illustrated a second embodiment of the pump of the invention. This embodiment is substantially the same as the first embodiment of FIG. 2 except that the seal member 40 is fitted in an annular groove 41 formed in the outer peripheral surface of the open end of the pump body 10. The seal member 40 has a side surface in fluid-sealing contact with the surface of the washer 33 so as to keep the junction between the pump body 10 and the washer 33 unexposed to the environment and prevent water and/or brine from coming into contact with the junction between the pump body 10 and the washer 33. This is effective to prevent corrosion of the pump body 10.

The seal member 40 may be made of a material, for example, zinc alloy, baser than those of the pump body 10, the joint 30 and the washer 33. In this case, electrochemical corrosion may occur at the junction of the seal member 40 to one of the pump body 10, the joint 30 and the washer 33 in the presence of water and/or brine. However, the zinc alloy of the seal member 40 will first be subject to corrosion. This is effective to avoid corrosion of the pump body 10.

Figure 5:
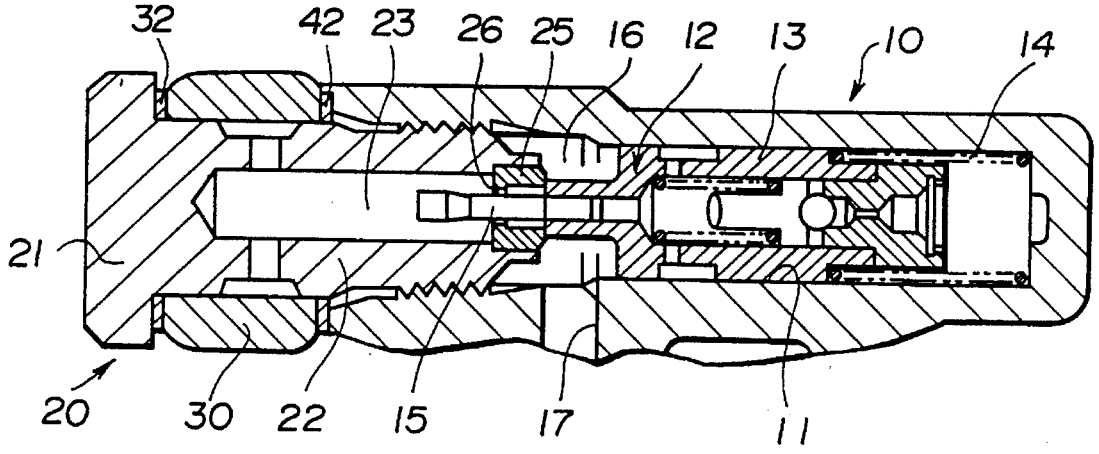
FIG. 5 is a sectional view showing a third embodiment of the pump of the invention.
Figure 6:
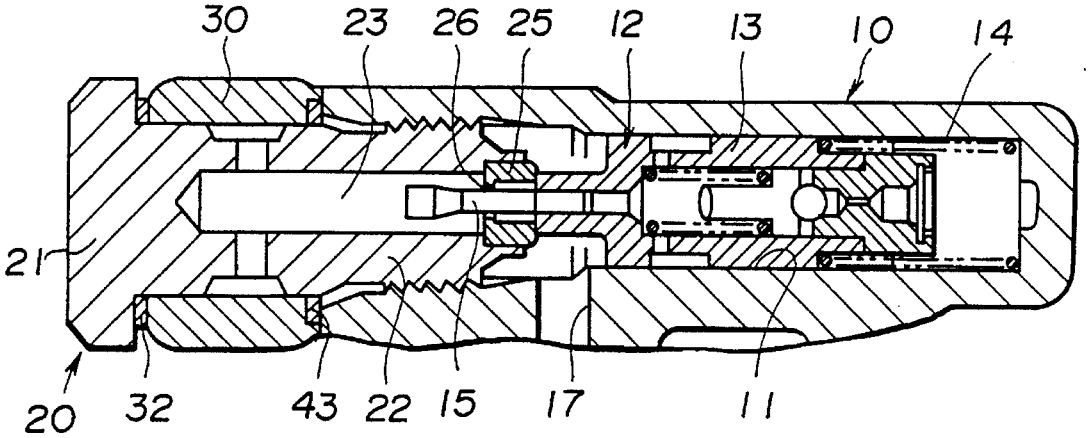
FIG. 6 is a sectional view showing a modified form of the third embodiment of the invention.

Referring to FIG. 5, there is illustrated a third embodiment of the pump of the invention. This embodiment is substantially the same as the first embodiment of FIG. 2 except that the seal member 40 is removed and the washer 33 is fitted in an annular recess 42 formed in the inner peripheral surface of the open end of the pump body 10. In this embodiment, the annular wall of the open end of the pump body 10 is in fluid-sealing contact with the joint 30 to keep the junction between the pump body 10 and the washer 33 unexposed to the environment and prevent water and/or brine from coming into contact with the junction between the pump body 10 and the washer 33. This is effective to prevent corrosion of the pump body 10. It is to be noted that the washer 33 may be positioned in an annular recess 43 formed in the inner peripheral surface of the joint 30, as shown in FIG. 6. Alternatively, the washer 33 may be positioned with its one half placed in an annular recess formed in the inner peripheral surface of the open end of the pump body 10 and the other half thereof placed in an annular recess formed in the inner peripheral surface of the joint 30.

Figure 7:
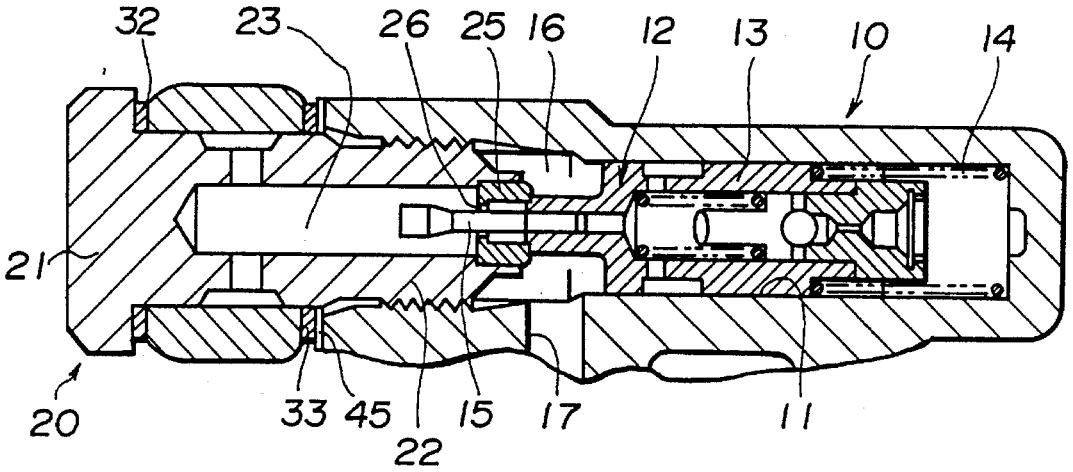
FIG. 7 is a sectional view showing a fourth embodiment of the pump of the invention.

Referring to FIG. 7, there is illustrated a fourth embodiment of the pump of the invention. This embodiment is substantially the same as the first embodiment of FIG. 2 except that the seal member 40 is removed and replaced with an annular thin member 45 positioned between the pump body 10 and the washer 33. The annular thin member 45 is made of rubber, synthetic resin, or other electrically insulating material. Preferably, the annular thin member 45 is integrally jointed to the washer 33 or the annular end surface of the pump body 10. The electrically insulating member 45 prevents electric conduction between the pump body 10 and the washer 33. This is effective to prevent corrosion of the pump body 10 even in the presence of water and/or brine between the pump body 10 and the washer 33.

Figure 8:
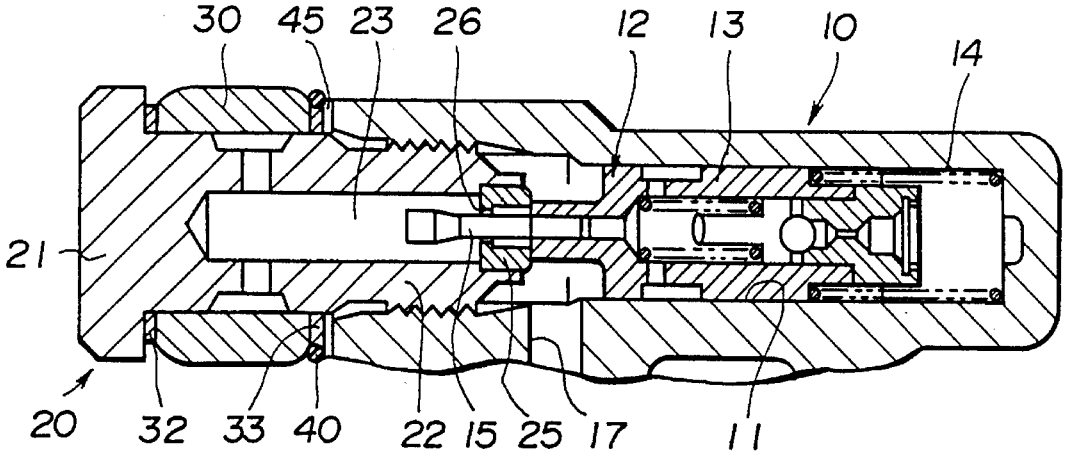
FIG. 8 is a sectional view showing a fifth embodiment of the pump of the invention.

Referring to FIG. 8, there is illustrated a fifth embodiment of the pump of the invention. This embodiment is substantially the same as the first embodiment of FIG. 2 except that an annular thin member 45 is positioned between the pump body 10 and the washer 33. The annular thin member 45 is made of rubber, synthetic resin, or other electrically insulating material. Preferably, the annular thin member 45 is integrally jointed to the washer 33 or the annular end surface of the pump body 10. The electrically insulating member 45 prevents electric conduction between the pump body 10 and the washer 33. This is effective to prevent corrosion of the pump body 10 even in the presence of water and/or brine between the pump body 10 and the washer 33.

The seal member 40 may be made of a material, for example, zinc alloy, baser than those of the pump body 10, the joint 30 and the washer 33. In this case, electrochemical corrosion may occur at the junction of the seal member 40 to one of the pump body 10, the joint 30 and the washer 33 in the presence of water and/or brine. However, the zinc alloy of the seal member 40 will first be subject to corrosion. This is effective to avoid corrosion of the pump body 10.

Figure 9:
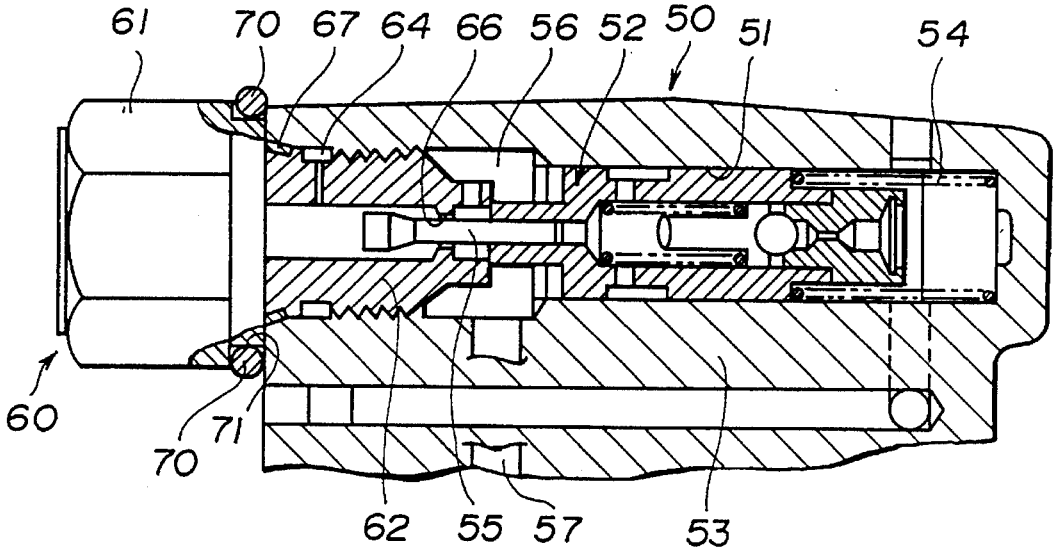
FIG. 9 is a sectional view showing a sixth embodiment of the pump of the invention.

Referring to FIG. 9, there is illustrated a sixth embodiment of the pump of the invention. In this embodiment, the pump comprises a pump body 50 and a joint 60 generally axially aligned with the pump body 50. The pump body 50, which is made of an aluminum alloy, is provided with a longitudinally extending bore 51 closed at its one end. The bore 51 has an internally threaded portion near its open end. The joint 60 has a head portion 61 and a stem portion 62 provided with externally threaded portion. The stem portion 62 is inserted into the bore 51 with its externally threaded portion being engaged with the internally threaded portion of the bore 51 so as to fix the joint 60 with respect to the pump body 50. The stem portion 62 has a longitudinally extending passage 63 connected to an annular passage 64 formed in its peripheral outer of the stem portion 62 of the joint 60. The passage 63 has an control orifice (center aperture) 66 therein. The bore 51 contains a flow control valve 52 having a valve body 53 provided for longitudinal sliding movement within the bore 51. A compression spring 54 is placed to urge the valve body 53 into abutment against the tip end of the stem portion 62 of the joint 60. The valve body 53 has a needle 55 extending through the control orifice 66. A pressure chamber 56 is defined in the bore 51 between the valve body 53 and the joint 60. The pressure chamber 56 is connected to a pressure source (not shown) through an inlet port 57 formed in the pump body 50. The numeral 67 designates a seal ring provided between the pump body 50 and the joint 60.

Working fluid is introduced under pressure through the inlet port 57 in to the pressure chamber 56. According to a pressure differential produced across the control orifice 66, the needle 55 opens and closes the control orifice 66 to control the flow of the working fluid through the control orifice 66 from the pressure chamber 56 to the passage 63. The working fluid is then discharged into the annular passage 64 and hence through the joint 60 to an actuator (not shown) used in the power steering unit.

Figure 10:
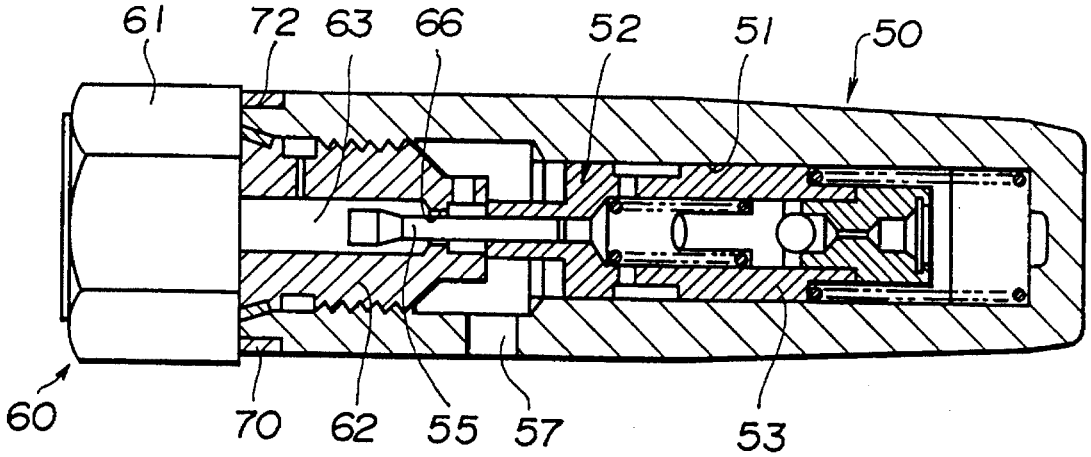
FIG. 10 is a sectional view showing a modified form of the sixth embodiment of the invention.

The joint 60 is made of a material different from that of the pump body 50. The different materials of the pump body 50 and the joint 60 form a galvanic junction which is susceptible to corrosion. An annular seal member 70 is provided in an annular groove 71 formed in the outer peripheral surface of the end of the head portion 61 of the joint 60. The seal member 70, which may be made of rubber, synthetic resin, or the like, covers the junction between the pump body 50 and the joint 60 to keep this junction from exposure to the environment and prevent water and/or brine from coming into contact with the junction between the pump body 50 and the joint 60. This is effective to prevent corrosion of the pump body 50. It is to be noted that the seal member 70 may be positioned in an annular groove 72 formed in the outer peripheral surface of the pump body 50, as shown in FIG. 10. Alternatively, the seal member 70 may be positioned with its one half placed in an annular groove formed in the outer peripheral surface of the pump body 50 and the other half thereof placed in an annular groove formed in the outer peripheral surface of the joint 60.

The seal member 70 may be made of a material, for example, zinc alloy, baser than those of the pump body 50 and the joint 60. In this case, electrochemical corrosion may occur at the junction of the seal member 40 to one of the pump body 10 and the joint 30 in the presence of water and/or brine. However, the zinc alloy of the seal member 40 will first be subject to corrosion. This is effective to avoid corrosion of the pump body 10.

Figure 11:
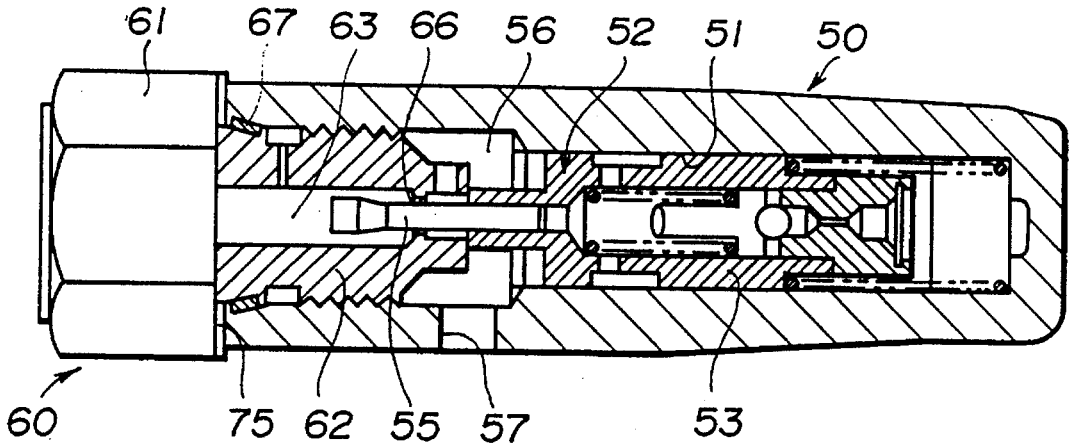
FIG. 11 is a sectional view showing a seventh embodiment of the pump of the invention.

Referring to FIG. 11, there is illustrated a seventh embodiment of the pump of the invention. This embodiment is substantially the same as the sixth embodiment of FIG. 9 except that an annular thin member 75 is positioned between the pump body 50 and the joint 60. The annular thin member 75 is made of rubber, synthetic resin, or other electrically insulating material. Preferably, the annular thin member 75 is integrally jointed to the annular end surface of the pump body 50 or the joint 60. The electrically insulating member 75 prevents electric conduction between the pump body 50 and the joint 60. This is effective to prevent corrosion of the pump body 50 even in the presence of water and/or brine between the pump body 50 and the washer 33.

What is claimed is:

1. A pump comprising a pump body having a control valve for controlling working fluid flow from the pump body to an actuator through a joint, the joint being connected mechanically to the pump body through a washer made of a material different from that of the pump body, the washer having a side surface held in contact with the pump body at a galvanic junction, and an annular seal member between the pump body and the joint to cover the outer peripheral surface of the washer, said annular seal member provided to keep the junction unexposed to the environment, and said seal member comprising a means for the prevention of corrosion of the junction wherein the pump body is made of aluminum and is provided with a bore closed at one end and open at the other end, said pump body having an annular end wall adjacent the open end of the bore, including a connector having a head portion and a stem portion, with the stem portion inserted into said bore through the open end of the bore, wherein said joint is made of iron, and said joint is mounted on said stem portion and disposed between said head portion and the annular end wall of the pump body.

2. A pump according to claim 1, including an additional washer made of a copper alloy positioned around the stem portion of the connector between said joint and the head portion of the connector.

3. A pump according to claim 2, wherein the washer having a side surface held in contact with the pump body is made of a copper alloy and is positioned around the stem portion of the connector between said joint and the annular end wall of the pump body.

4. A pump comprising:

a pump body made of an aluminum alloy, said pump body being provided with a bore closed at one end and open at the other end, said pump body having an annular end wall adjacent the open end of said bore;

a connector having a head portion and a stem portion, with the stem portion inserted into said bore through the open end of said bore;

a joint made of an iron mounted on said stem portion and disposed between the head portion of the connector and the annular end wall of said pump body;

a first washer made of a copper alloy positioned around said stem portion of the connector between the joint and the head portion of said connector;

a second washer made of a copper alloy positioned around the stem portion of the connector between the joint and the annular end wall of said pump body, said second washer having an outer peripheral surface; and an annular seal member on said outer peripheral surface of the second washer, said annular seal member having a thickness greater than that of said second washer and covering the whole area of said outer peripheral surface of said second washer so as to keep a galvanic junction between said pump body and said second washer unexposed to the environment wherein said seal member comprises a means for the prevention of corrosion of the junction.

5. A pump according to claim 4, wherein said annular seal member is made of a material selected from a group consisting of rubber, synthetic resin, and zinc alloy.

* * * * *